US006073277A

United States Patent [19]

Banks

[11] Patent Number: 6,073,277

[45] Date of Patent: Jun. 13, 2000

[54] HYDROTHERAPY CHAIR WITH AERATING PAD

[76] Inventor: David S. Banks, 3411 Oakcrest Dr., Shelby, N.C. 28150

[21] Appl. No.: 09/165,893

[22] Filed: Sep. 30, 1998

Related U.S. Application Data

[63] Continuation-in-part of application No. 08/806,566, Feb. 25, 1997, abandoned, which is a continuation-in-part of application No. 08/216,849, Mar. 24, 1994, Pat. No. 5,682,626.

[51] Int. Cl.[7] ..... A61H 33/02

[52] U.S. Cl. ..... 4/541.5; 4/579

[58] Field of Search ..... 4/541.5, 559, 578.1, 4/579, 611

[56] References Cited

U.S. PATENT DOCUMENTS 5,606,751 3/1997 Baker ..... 4/579 X 5,682,626 11/1997 Banks, Jr. et al. ..... 4/541.5

*Primary Examiner*—Robert M. Fetsuga

*Attorney, Agent, or Firm*—Clifton T. Hunt

[57] ABSTRACT

An economical hydrotherapy apparatus is provided for domestic use in conventional bathtubs. The apparatus includes a hydrotherapy chair and a relatively movable aerating pad, molded from plastic, that are placed in a bathtub for use with the seat of the chair at or near the surface of water in the bathtub. The aerating pad is spaced about eight inches below the surface of the water. An air compressor, located outside the bathtub, provides air that is delivered into the water from penetrations in the aerating pad. The introduction of compressed air at a depth of about eight inches creates therapeutic undulations of water against the seat and posterior of the user at the surface of the water.

3 Claims, 3 Drawing Sheets

HYDROTHERAPY CHAIR WITH AERATING PAD

Cross Reference to Related Applications

This application is a continuation-in-part of patent application Ser. No. 08/806,566, filed Feb. 25, 1997 by David S. Banks and Catherine B. Banks for HYDROTHERAPY APPARATUS AND METHOD now abandoned, which is a continuation-in-part of patent application Ser. No. 08/216,849 filed Mar. 24, 1994 by David S. Banks, Jr. and Catherine B. Banks for INVALID BATH CHAIR WITH THERAPEUTIC WHIRLPOOL, now U.S. Pat. No. 5,682, 626, issued Nov. 4, 1997.

FIELD OF THE INVENTION

This invention relates to durable medical equipment, and more specifically to therapeutic devices for therapy and rehabilitation of the posterior area of the body.

BACKGROUND OF THE INVENTION

Hydrotherapy treatments are of significant medicinal value when treating surgical and pathogenic conditions on or in the posterior area of the body, including but not limited to hemorrhoids or following hemorrhoid surgery; following groin surgeries, vaginal surgeries, or episiotomies; pathogenic therapy; peritoneal wounds; decubitus ulcers; postpartum complications; and/or other rectal surgeries and conditions.

Effective hydrotherapy and hydro-debridement for the posterior area of the body has heretofore been available only in hospitals and clinics equipped with "Hubbard tanks" and "Sitz baths".

The prior art fails, in every instance known to applicants, to provide a hydrotherapy apparatus for the posterior area of the body that is safe for domestic use in a household.

SUMMARY OF THE INVENTION

It is an object of the present invention to provide an open seat and an aerated pad for use beneath the surface of water in a bathtub. The aerated pad receives compressed air from an air pump designed for safe installation and operation outside the bathtub. The aerated pad is located near the bottom of the bathtub in vertically spaced relation to the open seat. Compressed air delivered to the aerated pad from the air compressor creates therapeutic undulations of the water at its surface and at the open seat, thereby effectively cleansing and massaging the posterior area of the body resting on the seat.

DETAILED DESCRIPTION OF A PREFERRED EMBODIMENT OF THE INVENTION

Figure 1:
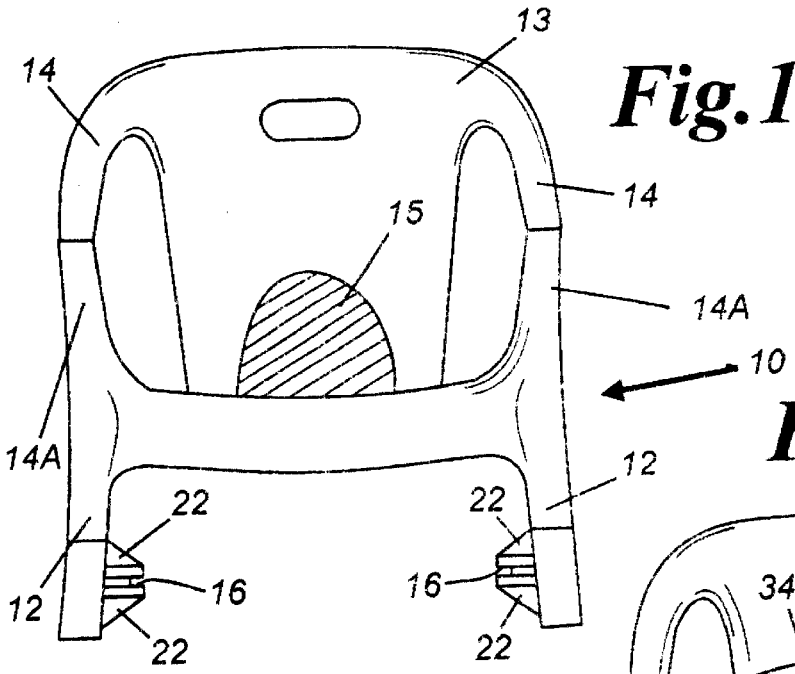
FIG. 1 is a front view of a conventional sitz bath chair with the shaded portion indicating a portion that is cut away to provide the hydrotherapy chair that is used with the aerating pad of FIG. 3 to define this invention.
Figure 2:
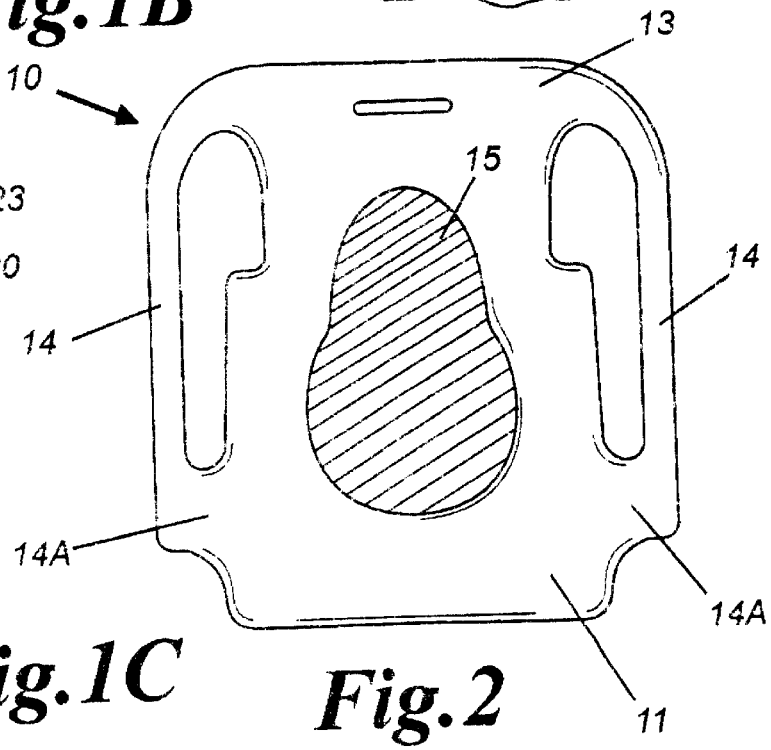
FIG. 2 is a top view of the hydrotherapy chair shown in FIG. 1, with the shaded area indicating the portion that is cut away to provide the hydrotherapy chair.
Figure 3:
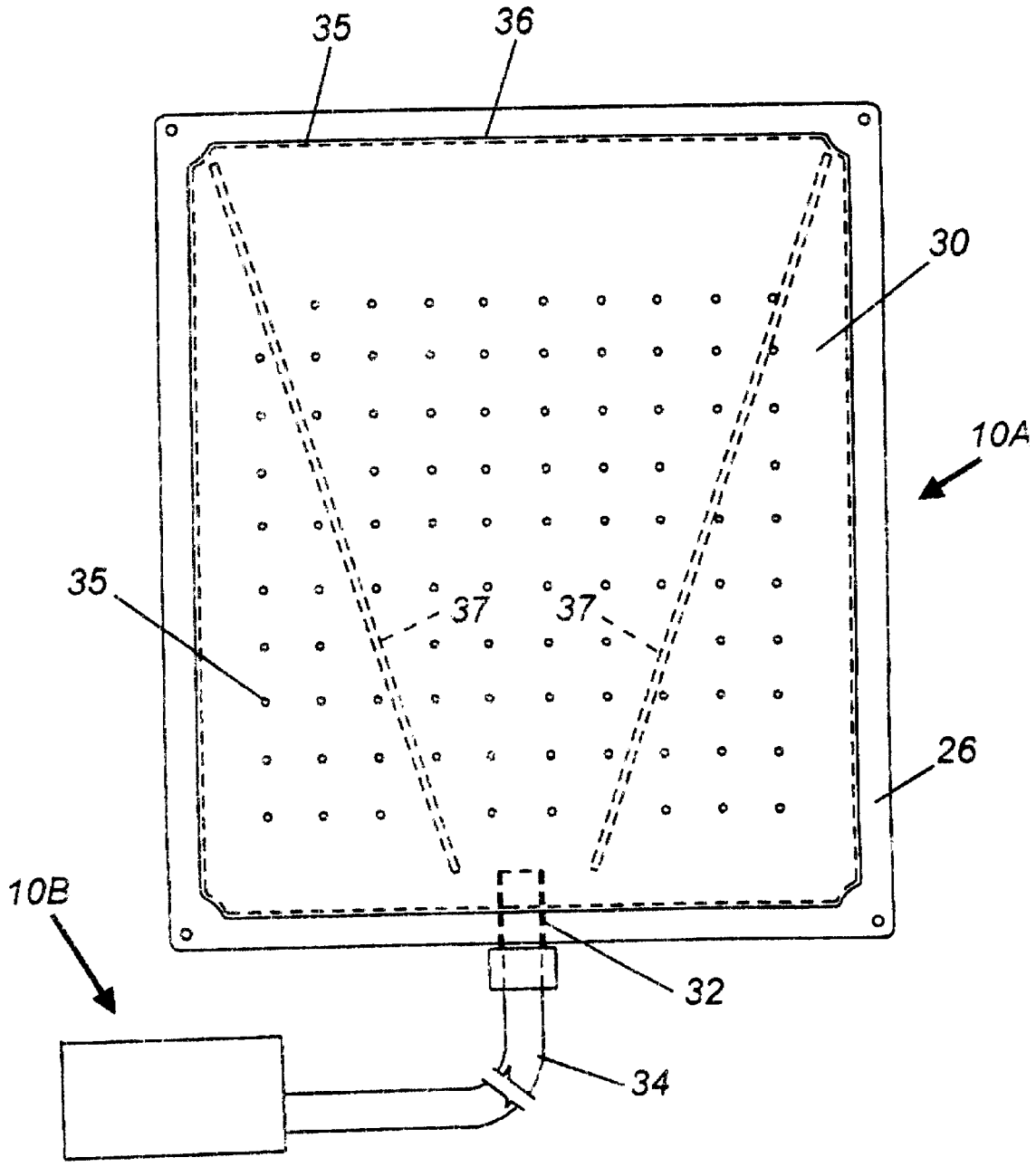
FIG. 3 is a top view of the aerating pad, wherein the dotted lines indicate baffles beneath the top surface of the pad, and a schematic illustration of the air compressor that provides air to the aerating pad.
Figure 4:
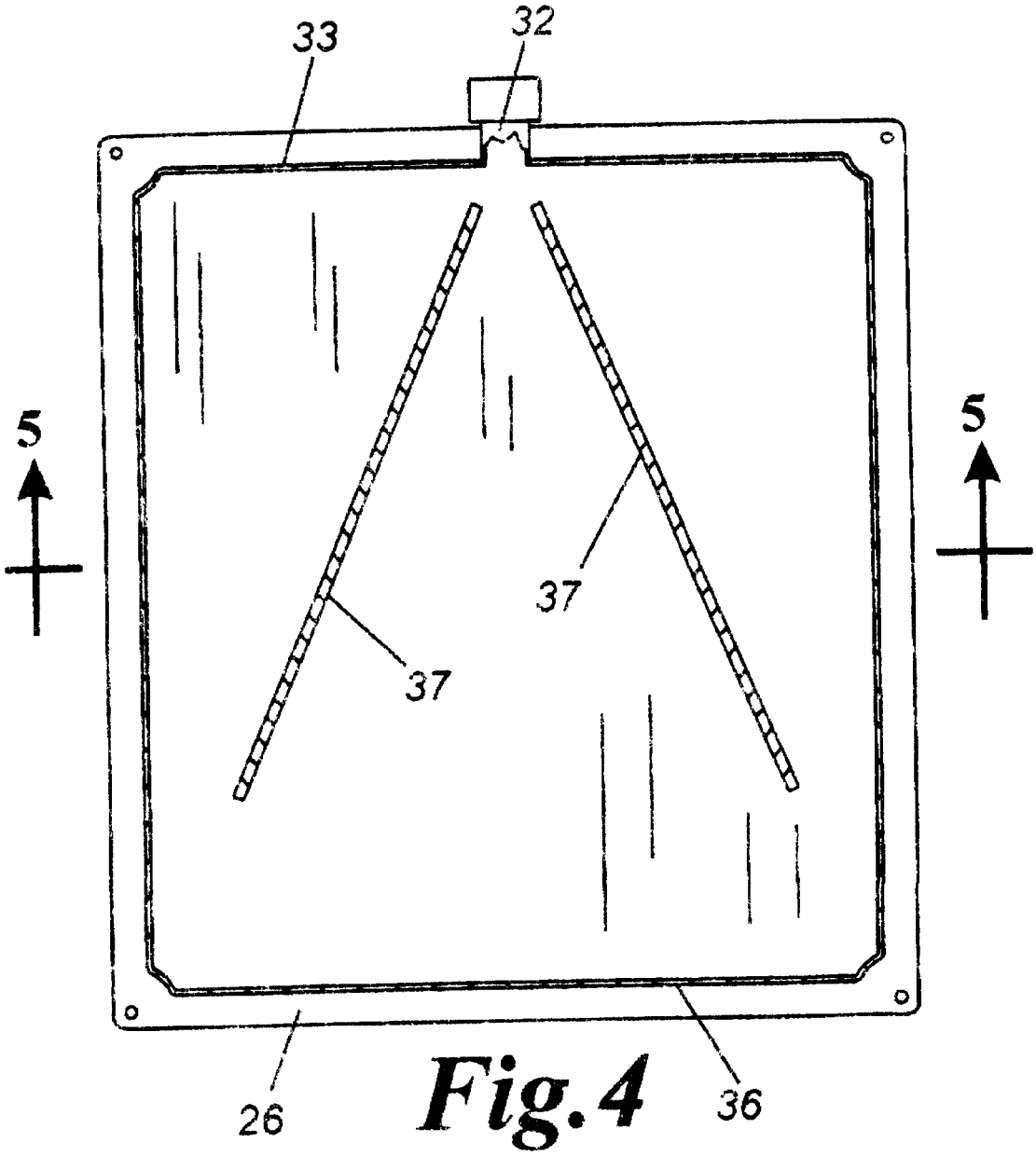
FIG. 4 is a sectional view of the aerating pad.
Figure 5:
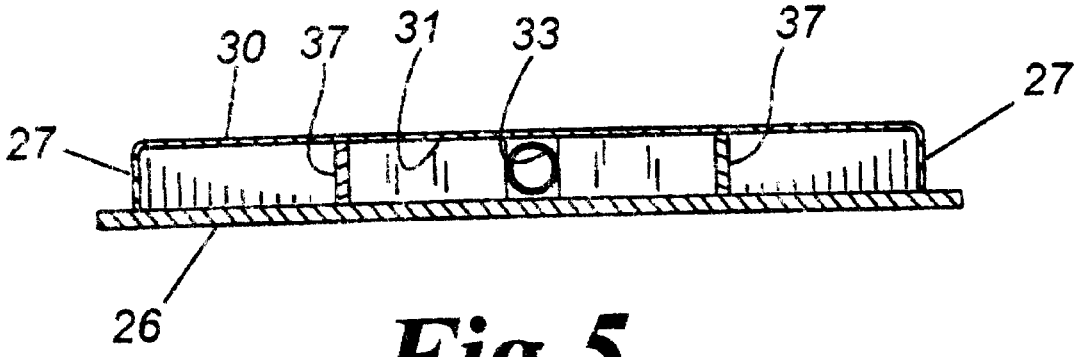
FIG. 5 is a sectional view taken substantially along the line 5—5 in FIG. 4.

Referring more specifically to the drawings, the hydrotherapy chair is broadly indicated at 10 in FIGS. 1 and 2; the aerating pad is broadly indicated at 10A in FIGS. 3, 4 and 5; and an air compressor 10B, schematically illustrated in FIG. 3, is provided for delivering air to the aerating pad 10A.

The hydrotherapy chair 10 is a conventional sitz bath chair molded from a suitable plastic, such as polystyrene or other suitable plastic. As shown in FIGS. 1 and 2, the conventional sitz bath chair includes a seat 11 supported on legs 12, a back 13 curving upwardly from the rear of the seat, and arms 14 curving downwardly from the back, 13 on opposite sides of the seat 11. The arms 14 terminate in vertical portions 14A that are molded into the sides of the seat 11 (FIG. 2).

The hydrotherapy chair of this invention is formed from a conventional sitz bath chair that has been modified by cutting away portions of the seat and back of the conventional sitz bath chair to expose more of the posterior area of the body to the unique hydrotherapy of this invention. The conventional sitz bath chair has been strengthened to compensate for the cut away portions by increasing the thickness of the conventional sitz bath chair to ½ inch minimum. The portions of the conventional sitz bath chair that are cut away to expose more of the body to therapy are indicated by the shaded area 15 on the back 13 of the chair 10 and by the shaded area 15A on the seat 11 of the chair 10.

The unique therapy that is provided by this invention is caused by compressed air being delivered from the air compressor 10B to the aerating pad 10A and into the water a sufficient distance beneath the seat 11 of the chair 10 to impart an undulating movement to the water that contacts the exposed portions of the body.

Figure 1A:
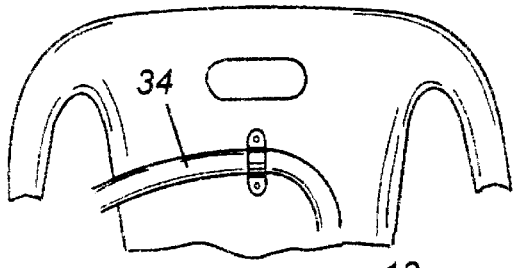
FIG. 1A is a rear view, with parts broken away, of the hydrotherapy chair shown in FIG. 1, and illustrating the attachment to the back of the chair the hose that connects the aerating pad to an air compressor.
Figure 1B:
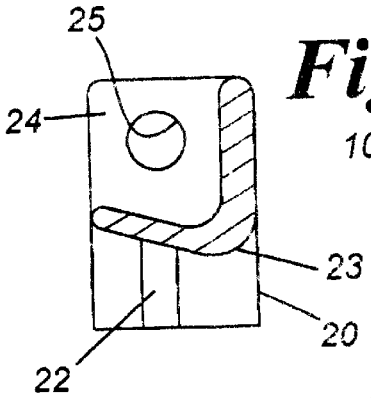
FIG. 1B is a sectional view through one rear leg of the chair shown in FIG. 1, and showing a threaded hole through the bottom of the leg to receive one of the suction cups that attach the chair to the bathtub.
Figure 1C:
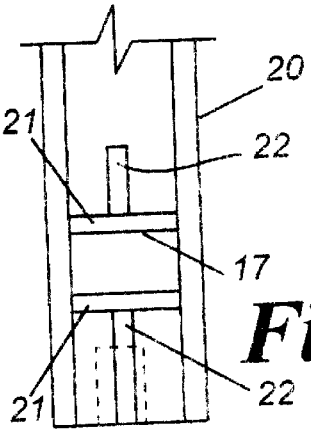
FIG. 1C is a front view, with parts broken away, of the rear leg shown in FIG. 1B and illustrating a portion of the channel that attaches the aerating pad to the hydrotherapy chair.

The aerating pad 10B is located a sufficient distance below the seat 11 of the chair to produce the desired undulations and is maintained in that position by being removably positioned in channels 16 that open toward each other from the legs 12 on the front of the chair 10 (FIG. 1) and in channels 17 that open toward the front of the chair 10 from the rear legs 20 of the chair 10 (FIG. 1C). Each of the channels 16 and 17 is defined by parallel walls 21 that are strengthened by gussets 22.

FIG. 1B is a sectional view through the angular vertical portion 23 of one of the rear legs 20, showing the rectangular bottom 24 of the leg 20. A gusset 22 extends forwardly from the vertical portion 23 and a threaded bore 25 extends through the bottom 24 behind the vertical portion 23. The bottom 24 and threaded bore 25 are common to all four legs. The threaded bores are provided in the bottoms of the legs for the reception of suction cup retainers. The suction cups, not shown, grip the bottom of the bathtub and stabilize the hydrotherapy chair in use.

The aerating pad 10A is slid into the channels 16 and 17 from the front of the chair 10. This places the aerating pad 10A approximately eight inches beneath the seat 11 of the hydro-chair 10. The bathtub is preferably filled for most therapies with enough water to reach the seat 11 of the chair 10. With the seat 11 at the surface of the water, it is spaced about eight inches above the aerating pad 10A.

The aerating pad 10A is formed from a rigid plastic such as polyethylene and comprises an imperforate base 26 and side walls 27 formed integrally with a perforated top wall 30 defining a hollow chamber 31. A tubular junction 32 extends from one wall 33 for connection to a flexible tube or hose 34 extending from the air compressor 10B. As seen in FIG. 1A, the hose 34 may be releasably supported on the back of the chair 10.

Compressed air released from the compressor 10B has been heated by the electric motor in the compressor while the air is compressed. The heated air passes through the tube 34 to the chamber 31 and into the water between the pad 10A and the seat 11 through perforations 35 in the top wall 30 and in the front wall 36 of the aerating pad.

In the illustrated embodiment, there is a grid of one hundred perforations 35 in the top wall 30 and ten perforations 35 along the front wall 36 of the aerating pad 10A. Each of the perforations 35 measures approximately one mm in diameter.

A pair of baffles 37 within the chamber 31 extend between the base 26 and the top wall 30 of the aerating pad. The baffles 37 strengthen the hydro-pad to prevent deformation of its chamber, and diverge from each other, as shown in FIGS. 3 and 4 to evenly distribute air from the compressor 10B throughout the chamber 31 before the air escapes into the water through the perforations 35.

The air compressor 10B is situated outside the bathtub and includes an electric motor (not shown) suitably connected to a source of electricity in a conventional manner. Operation of the air compressor is controlled by an air switch (not shown) accessible to an occupant of the hydrotherapy chair 10. Operation of the air switch controls the air compressor in lieu of the usual electric control to prevent a person in the bathtub from having contact with an electric switch.

The air compressor 10B is capable of pressurizing air up to 150 psi, but the pressure of the air delivered to the air chamber 31 is variable and is controlled by operation of the air switch. Air leaving the air compressor 10B at 150 psi is reduced to about 14 psi as the air enters the water through the perforations 35 in the aerating pad. The reduction in pressure is caused by the air passing through the tube 34, then being diverted by the baffles 37 throughout the chamber 31, and escaping through the perforations 35 in the top wall and in the front wall of the aerating pad.

Air entering the water at 14 psi through the widespread perforations 35 creates rapid undulation of the water against the area of the body receiving therapy. Reducing the air pressure by operation of the air switch reduces the undulation, which is desired for some therapies.

When it is desired to provide hydrotherapy to the legs and/or feet, the aerating pad 10A may be repositioned from its normal position directly beneath the seat 11 of the chair 10 to a position directly beneath the area to be treated on the legs or feet of the user. The repositioning of the aerating pad 10A to provide therapy for a selected area of the legs or feet may be easily accomplished by manually sliding the aerating pad forwardly in the channels 16 to the desired location.

The aerating pad 10A is the same structure as the hydro-pad 50 in the parent application, Ser. No. 08/806,566, and may be used by either attaching it to the legs of the hydro-chair 10, as described in the parent application, Ser. No. 08/806,566, or by suitably positioning the aerating pad in the channels on the legs of the hydrotherapy chair 10, as heretofore described, There is thus provided an improved hydrotherapy apparatus comprising a hydrotherapy chair and an aerating pad molded from plastic and which may be economically produced in quantity, and wherein the aerating pad may be advantageously repositioned relative to the hydrotherapy chair to provide therapy for the legs and feet.

Although specific terms have been used in describing the invention, they have been used in a generic and descriptive sense only and not for the purpose of limitation, the scope of the invention being defined in the following claims.

I claim:

1. A hydrotherapy apparatus for domestic use in a bathtub and comprising:

a hydrotherapy chair and an aerating pad molded from plastic;

the hydrotherapy chair being shaped to define a seat and a back supported on front and rear legs, channels on the proximal surfaces of the front legs and on the forward surfaces of the rear legs, whereby a user of the hydrotherapy apparatus may manually position opposite sides of the aerating pad in the channels on the front legs of the hydrotherapy chair and the aerating pad may be manually moved through those channels to a selected position relative to the hydrotherapy chair, the seat and back having an opening to expose for therapy the posterior area of a user;

the aerating pad comprising a base, side walls, a perforated top wall and an inlet opening integrated as a unit;

an air compressor for delivering air to the aerating pad; and means for operably connecting the air compressor to the aerating pad.

2. The invention of claim 1 wherein the opening in the seat and back of the hydrotherapy chair for therapeutic purposes is of a generally oval shaped configuration with the larger part of the opening in the medial portion of the seat and the smaller part of the opening in the medial portion of the back of the hydrotherapy chair.

3. The invention of claim 1 wherein the legs of the hydrotherapy chair include bottoms with a threaded bore.

* * * * *